United States Patent [19]

Barkhuff

[11] 4,082,399

[45] Apr. 4, 1978

[54] ZERO-INSERTION FORCE CONNECTOR

[75] Inventor: Earl D. Barkhuff, Staatsburg, N.Y.

[73] Assignee: International Business Machines Corp., Armonk, N.Y.

[21] Appl. No.: 698,972

[22] Filed: Jun. 23, 1976

[51] Int. Cl.[2] ..... H01R 13/62

[52] U.S. Cl. ..... 339/75 M; 339/17 CF; 339/254 M; 339/256 RT

[58] Field of Search ..... 339/17 C, 17 CF, 17 E, 339/75 M, 176 MP, 61 R, 61 M, 252 R, 252 S, 259 R, 259 M, 256 R, 256 T, 275 B

[56] References Cited

U.S. PATENT DOCUMENTS 2,902,629 9/1959 Little et al. ..... 339/17 C X

OTHER PUBLICATIONS

Kennedy et al., Pluggable Wire Wrapping Connector, IBM Technical Enclosure Bulletin, vol. 6, No. 1, June 1963, pp. 36, 37

*Primary Examiner*—Roy Lake

*Assistant Examiner*—E. F. Desmond

*Attorney, Agent, or Firm*—Harold H. Sweeney, Jr.

[57] ABSTRACT

A zero-insertion force connector for a multi-pin module is provided having a plurality of short, narrow resilient conductive contact members, each of which has a lengthwise opening therethrough of a diameter slightly greater than a module pin so as to each receive a module pin with substantially zero friction. One end of the contact is located in a plate having a plurality of openings therein each centered with respect to one of the pin positions and having a diameter somewhat larger than the contact so the contact can move therein to adjust for pin misalignment. An actuator plate is provided located adjacent to the module locating plate and connected with each of said contact members so as to provide in its actuated condition bending of said contact members so as to wipe and substantially circumferentially contact the module pin inserted in the end of the contact member within the module locating plate. Fan-out connection means is provided for making an electrical connection to the other end of each of the contacts.

10 Claims, 5 Drawing Figures

ZERO-INSERTION FORCE CONNECTOR

BACKGROUND OF THE INVENTION

1. Statement of the Invention

The invention relates to a zero insertion force connector for a multi-pin module and more particularly, to a zero- insertion force connector for a multi-pin module wherein the contacts are self-adjusting to operate with pins which are misaligned and which, when actuated, wipe and circumferentially grip the pins to provide good electrical connections.

2. Description of the Prior Art

With the development of large scale integration, the circuitry has become smaller and smaller and, accordingly, the connections made from the circuitry, for example on a chip, to a further electrical element is done by a high density array of thin pins. For example, a two inch by two inch circuit module may have upwards of a 1,000 pins extending from one of the surfaces thereof. One of the biggest problems with the connector utilized to connect the pins to further electrical circuits is the delicate nature or the tendency of the pins to bend. One of the more popular connectors for connecting a high density array of pins is known as the "Harcon" (Registered Trademark of Berg Electronics) connector, the contacts of which have a modified U shape somewhat like a clothespin into which the pins fit. It has been found that these connectors have a limited number of cycle times, that is, a limited number of make-break operations before failure takes place. Other connectors capable of making connections to pins in high density situations are known, but are for the most part rather intolerant to pin misalignments, expensive, have low cycle lives and require considerable force to complete the connection.

SUMMARY OF THE INVENTION

Accordingly, it is the main object of the present invention to provide a connector wherein the number of cycles is substantially increased before connector failure occurs.

It is another object of the present invention to provide a zero-insertion force connector for a multi-pin module.

It is a further object of the present invention to provide a zero-insertion force connector in which the contacts are self-adjusting for pin misalignment due to bending.

Briefly, the invention consists of a zero-insertion force connector for a multi-pin module wherein a plurality of short narrow, resilient, conductive contact members are provided each having a lengthwise opening therethrough of a diameter slightly greater than the pin diameter so as to each receive a pin of a module with substantially zero frictional force. One end of the contact is located in a module locating plate having a plurality of openings therein each centered with respect to one of the pin positions and having a diameter somewhat larger than the contact so the contacts can move therein to adjust for pin misalignment. An actuator plate is provided located adjacent to said module locating plate and connected with each of said contact members so as to provide in its actuated condition bending of said contact members. The actuator plate is actuated by means which cause movement with respect to the module locating plate thereby bending each of the contacts so as to wipe and substantially circumferentially contact the module pin inserted in the ends of the contact member within the module locating plate to make a good electrical connection therewith. Fan-out connection means are provided for making electrical connections to the other ends of said contacts.

The foregoing and other objects, features and advantages of the invention will be apparent from the following more particular description of preferred embodiments of the invention as illustrated in the accompanying drawings.

DETAILED DESCRIPTION OF THE PREFERRED EMBODIMENTS

Figure 1:
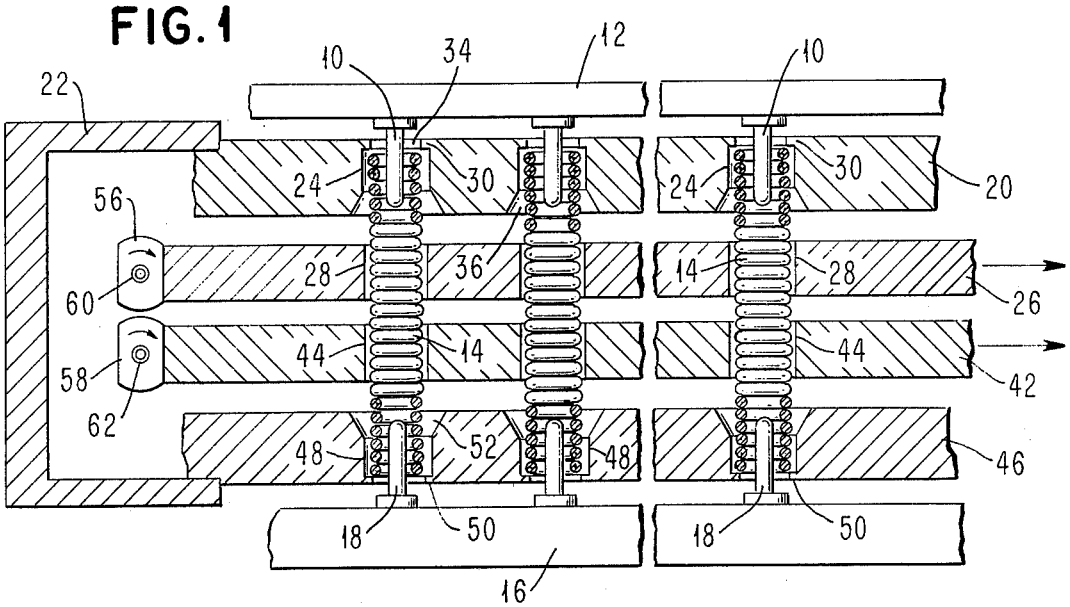
FIG. 1 is a partly sectioned vertical schematic of a connector for a multi-pin module showing the contacts in their zero-insertion force condition.

Referring to FIG. 1 there is shown a partial cross-section of the connector showing schematically the pins 10 of the module 12 plugged into the contacts 14 of the connector. Likewise the fan-out board 16 is shown plugged into the other end of the contacts 14 via pins 18. It should be appreciated that the module 12 and fan-out board 16 include an extremely high density of pins and, accordingly, the connector includes a corresponding number of contacts 14 to complete the electrical connections therebetween. The module locating plate 20 is fixed in a frame 22 and has a plurality of openings 24 therethrough which are indexed with the pin 10 positions on the module 12. An actuator plate 26 is located adjacent the bottom surface of the module locating plate 20. This actuator plate 26 is slideably mounted in frame 22 and also contains a plurality of openings 28 therein each of which is indexed with an opening 24 in the module locating plate 20. A contact 14 having a short, thin, cylindrical shape with an opening therethrough is located within the openings 24 and 28 in the module locating plate 20 and the actuator plate 26, respectively. As can be seen in FIG. 1, the opening 24 in the module locating plate 20 has a diameter which is somewhat larger than the outside diameter of the contact 14. This provides a very important feature of the invention, since the pins 10, when inserted in the openings in the top of the contacts 14, if slightly off-center will cause the contact to automatically adjust to the misalignment by moving it within its larger diameter openings 24. Thus, pins 10 that are slightly misaligned or bent can still be inserted into the opening within the contact 14 because of this ability of the contact 14 to adapt itself to the misaligned position of the pin 10. The opening 28 in the actuator plate 26 has a diameter slightly larger than the outside diameter of the contact 14 so that the contact 14 fits into the actuator plate opening 28 and yet has substantially no play.

A slightly smaller diameter opening in the form of a flange 30 extends around the top of the opening 24 in the module locating plate 20. It should also be observed that the bottom edge 36 of the openings 24 in the module locating plate 20 are cut away so as to not interfere with the bending of the contact 14 when the actuator plate 26 is actuated.

It will be appreciated, that the connector when in its unactuated position as shown in FIG. 1, that is, when the openings 24 and 28 in the module locating plate and the actuating plate, respectively, are aligned the contact 14 located therein is positioned to receive the module pin 10 with substantially no frictional contact and thus, zero-insertion force is necessary for the multi-pin plugging of the module 12 to the connector. It can best be seen in FIG. 2, that the actuator plate 26 when moved or actuated with respect to the module locating plate 20 causes the contact 14 to bend so that the top part of the contact 14 located in the module locating plate 20 tends to wipe along the pin 10 and to circumferentially grip the pin 10 thereby making good electrical contact between the pin 10 and the contact 14.

Since it is necessary for the contact 14 to easily bend, as just described, the contact 14 is made in the form of a coil spring which gives it considerable resiliency. In order to provide a better appreciation for some of the small sizes involved in the connector, sample dimensions will be provided. For example, the wire forming the coils of the contact 14 is 0.009 inches in diameter. The inside diameter of the contact is 0.019 inches. Also, the contact is 0.0370 inches long and has an outside diameter of 0.037 inches. Thus, the contact 14 is a short, thin, resilient, conductive member in the shape of a cylinder and has a narrow lengthwise opening therethrough. It was found that a contact 14 of the above given dimensions, when inserted in a module plate opening 34 of 0.046 inches in diameter and having a top flange 30 smaller diameter of 0.031 inches, when actuated by a displacement of the actuator plate 26 of approximately 0.015 inches provided a good electrical connection between the contact 14 and a pin of 0.013 inches plugged thereto. In a 100 pin model, the contact force of the contact against a pin at 0.015 inches deflection of the actuator plate was found to be approximately 40 grams per contact. Of course, the module locating plate 20 and the actuator plate 26 must be correspondingly small and have been built having a thickness of 0.067 inches and 0.062 inches, respectively. It has been found, that operation of the connector is satisfactory with a separation of the module locating plate 20 and the actuator plate 26 of 0.040 inches.

Referring again to FIG. 1 there is shown a similar connection scheme for making the connection to the pins 18 on a fan-out board 16. This requires the addition of a further actuator plate 42 located below the actuator plate 26 for actuating the connection of the bottom of the contact to the pins 18 of the fan-out board 16. It can be seen, that this actuator plate 42 has a like number of openings 44 therethrough of the same diameter and indexed with the openings 28 of the first mentioned actuator plate 26. A further locating plate 46, having a like number of openings 48 therein as the upper locating plate 20, is located adjacent the bottom surface of said actuator plate 42. These openings 48 in the bottom locating plate 46 have a flange 50 which extends into each of the openings 48 at the bottom thereof to retain the contact spring 14 and they also have a cut-away edge section 52, which in this case, is at the top edge of the opening 48 rather than the bottom edge of the opening, as is the case with the module locating plate 20 located above in FIG. 1. This bottom locating plate 46 is fixed in the frame 22 while the bottom actuator plate 42 is slidably attached to the frame. The operation of the actuator plates 26 and 42 is independent of one another so that the multi-pin module 12 connection to the connector can be made separately from the connection of the fanout board 16 thereto. Actually, the fan-out board 46 connection to the connector could be fairly permanent. Thus, the operation to make the connection of the fan-out board pins 18 with the connector is exactly the same as was described in connection with the module pins 10, above. The actuation of the actuator plates 26 and 42 is done independently by separate cams 56 and 58, respectively, as shown at the lefthand edge of the actuator plates. A knurled knob 60 and 62 is shown in connection with each of the cams 56 and 58 to provide the manual rotation required to give the deflection to the actuator plates 26 and 42. Springs (not shown) are located at the other end of the actuator plates 26 and 42 opposite the actuating cams 56 and 58 to return the actuator plates to their non-actuated position for removal of the respective module 12 or fan-out board 16.

Figure 2:
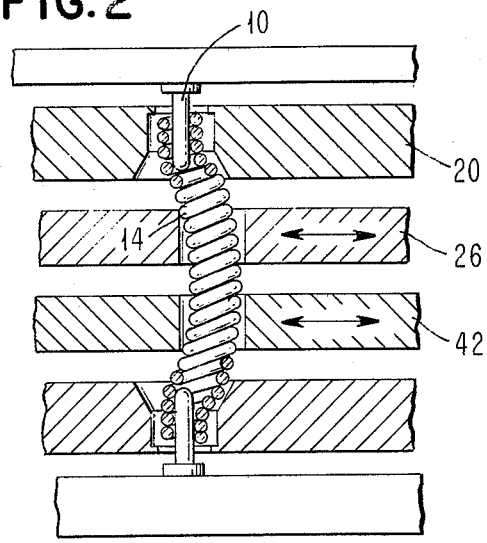
FIG. 2 is a partly sectioned vertical schematic of the connector of the present invention showing the actuator plates and contacts in the actuated position.
Figure 3:
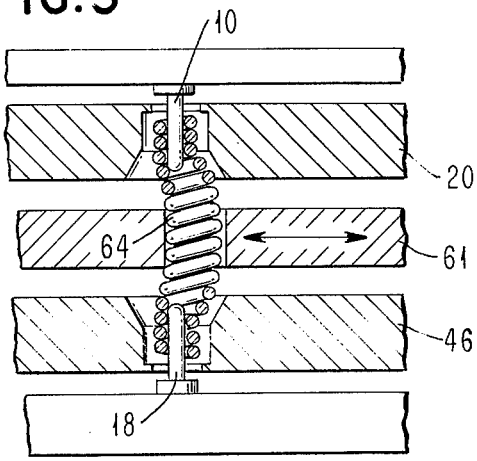
FIG. 3 is a partly sectioned vertical schamatic of a connector for a multi-pin module having a single actuator plate for connecting the module to a fanout board.

FIG. 2 shows the contact 14 in bent position making contact to the module pin 10 at the top of the contact and to the fan-out board pin 18 at the bottom of the contact when both of the actuator plates 26 and 42 are actuated or operated. The loops of the contact coils surrounding the respective pins wipe the pin, when the respective actuating plate is operated until they lie flat against the side of the pin, and for all practical purposes circumferentially grip the pin because of the skew applied to these loops of the contact coil. As previously mentioned, the operation of the actuator plates 26 and 42 can be independent of one another and, thus, the respective module pin connection and fanout board pin connection can be made or broken independently. If it is not desired to have independent operation of the two actuator plates 26 and 42 then it is only necessary to have one actuator plate 61 and thus provide module pin 10 connection and fanout board pin connection 18 simultaneously as shown in FIG. 3. It should be further noted in FIG. 3 that this modification allows the contact member 64 to be considerably shortened over the contact member 14 utilized in FIGS. 1 and 2. Thus, the actuation of the single actuator 61 causes the wiping and circumferential gripping contact of the contact member 64 simultaneously with respect to the module pin 10 and the fan-out board pin 18.

Figure 4:
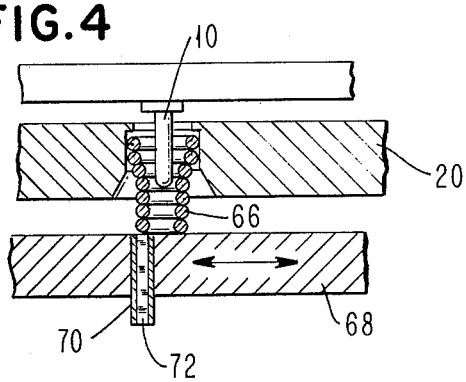
FIG. 4 is a partially sectioned vertical schematic showing a further embodiment of the zero-insertion force connector for a multi-pin module.

A further embodiment is shown schematically in FIG. 4 where only one of the plurality of module pins 10 is shown inserted in the spring contact member 66 within the module locating plate 20. The module locating plate 20 is the same as the module locating plate utilized in the above described embodiments, however, the actuator plate 68 does not have the usual openings therein. Instead, the actuator plate 68 has a ferrule or sleeve 70 of conductive material passing therethrough from the top to the bottom and extending out from the bottom side of the actuator plate 68 sufficiently far such that an electrical connection can be made thereto. The last or bottom winding of the contact 66 extends down through the middle of the ferrule 70 forming the fan-out contact. Other connection means are possible, for example, the bottom of the contact could be soldered into a plated thru hole in the fan-out board. As can be seen in FIG. 4, the contact member 66 utilized is extremely short and only extends in its coiled form to the upper surface of the actuator plate 68 and the straightened portion extends through the ferrule 70. This straightened portion 72 extending from the bottom coil of the contact 66 extends down from the side of the contact 66 at the end of the diameter of the coil which is parallel to the motion of the actuator plate 68. Thus, the actuation of the actuator plate 68 will cause the contact 66 to deflect so that the top coils thereof which surround the module pin 10 are sufficiently cocked or skewed to give a small amount of wiping and circumferential gripping contact with the module pin 10. It must be appreciated, that the movement of the actuator plate carrying the extended portion of the last coil when moved in the deflection direction will essentially displace the entire contact 66 since the contact is a cylindrically shaped member in which the coils are sufficiently rigid to move as a unit rather than just deflect one side thereof. Although we have described only one pin and contact, it should be understood that this particular design is for a high density of such pins and contacts in the connector.

FIG. 4 also shows the top few coils of the contact member 66 having an ever widening diameter as the top of the contact is approached. Accordingly, the top of the contact member 66 has a bell-mouth or funnel shape so that the module pin 10 can be more easily inserted therein even when the pin 10 has considerable misalignment. This feature of the invention is not limited to the FIG. 4 embodiment, but can be obviously utilized in any of the embodiments depicted or it can be utilized in connection with the bottom of the contact for connection to the fanout plate.

Figure 5:
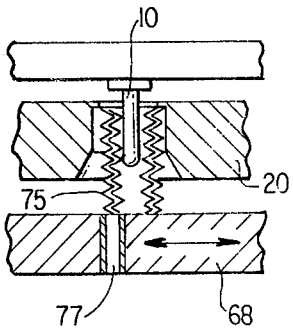
FIG. 5 is a partially sectioned vertical schematic showing a further embodiment including a bellows contact member.

It is important that the deflection vs. length of the spring contact be correctly determined so that there is no separation of the coils of the contact when in the deflected state. In other words the coils must continually touch each other even in the deflected or bent condition so that the electrical characteristics of the contact are not changed because of the deflection such as the inductance. It has been found that the contact member is not limited to a coil type spring but a small properly shaped bellows member that is conductive would also be suitable for this application. A short, thin, resilient, conductive bellows member might even have some advantage in that the continuity of the bellows member would not be broken by deflection such as might be the case with over-deflection of the coiled spring contact member. FIG. 5 shows the spring 66 of FIG. 4 replaced by a short, thin, resilient, conductive bellows 75. The fan-out electrical connection is made by soldering the bottom of the bellows 75 to a plated thru hole 77 which extends through actuator plate 68. The operation of the bellows 75 when displaced by actuator plate 68 is exactly the same as the operation of the spring member 66 described above in connection with FIG. 4.

While the invention has been particularly shown and described with reference to the embodiments thereof, it will be understood by those skilled in the art that the foregoing and other changes in form and detail may be made therein without departing from the spirit and scope of the invention.

What is claimed is:

1. A zero-insertion force connector for a multi-pin module comprising:

a plurality of short, narrow, resilient conductive contact members each having a longitudinal axis coaxial with a lengthwise opening therethrough of a diameter slightly greater than said pin so as to each receive a pin of a module with substantially zero friction;

a module locating plate located in a first plane and having a plurality of openings therein extending thru said plate perpendicular to the plane thereof, each opening containing an end of one of said contact members which extend coaxially beyond said openings from the same side of said module locating plate and each opening centered with respect to one of said pin positions and having a diameter somewhat larger than said contact member so the end of said contact member can move radially therein to adjust for pin misalignment;

an actuator plate located parallel to the plane of and adjacent the side of said module locating plate from which said contact members extend and contacting each of said contact members so as to provide in its actuated condition bending along the longitudinal axis of said contact members, means for actuating said actuator plate to move laterally with respect to said module locating plate thereby bending each of said contact members along its longitudinal axis so as to wipe and substantially circumferentially contact the module pin inserted in the end of said contact member within said module locating plate to make a good electrical connection therewith;

and fan-out connection means for making an electrical connection to the other end of each of said contact members.

2. A zero-insertion force connector according to claim 1, wherein each of said plurality of short, narrow, resilient, conductive contact members is a tightly wound spring, such that sufficient force exists between coils to keep them in intimate contact even when the contact member is bent along its longitudinal axis into the connected condition.

3. A zero-insertion force connector according to claim 1, wherein each of said plurality of short, narrow, resilient, conductive contact members is a bellows.

4. A zero-insertion force connector according to claim 1, wherein said module locating plate has a small flange around the top of each of said openings therein which extends radially into said openings sufficiently far to block the dropping out of said contact members.

5. A zero-insertion force connector according to claim 1, wherein said module locating plate openings have the bottom edge of the opening removed so that bending along the longitudinal axis of said contact member is not interfered with when said actuator plate is actuated.

6. A zero-insertion force connector according to claim 1, wherein said actuator plate has a plurality of openings therein each of which is centered with respect to a corresponding opening in said module locating plate when in its non-actuated state and having a diameter slightly larger than the outside diameter of said contact members so that respective contact members extend therethrough and into said module locating plate.

7. A zero-insertion force connector according to claim 6, wherein said fan-out connection means includes a further locating plate located adjacent to the other side of said actuator plate and having a plurality of openings therein each centered with respect to a respective opening in said actuator plate so that said contact members extending through the openings in said actuator plate are terminated within the openings of said further locating plate, said means for actuating said actuator plate causing motion thereof with respect to said further locating plate so that said contact members included in the openings thereof are bent along their longitudinal axis thereby providing wiping and substantially circumferential contact with a fan-out board pin inserted in the other end of said contact member within said further locating plate.

8. A zero-insertion force connector according to claim 7, wherein a further actuator plate is located between said actuator plate and said further locating plate, said further actuator plate having openings therein centered with respect to the openings in said actuator plate and through which said contact members pass, a further actuating means for actuating said further actuator plate to move with respect to said further locating plate thereby bending along its longitudinal axis each of said contact members contained in the openings in said further actuator plate so as to wipe and substantially circumferentially contact the fan-out board pin inserted in the other end of said contact member within said further locating plate.

9. A zero-insertion force connector according to claim 1, wherein each of said contact members is shortened and has an extension thereof connected to one side at one end thereof which is fixed in and passes through said actuator plate so that actuation of said actuating plate causes said contact member to bend along its longitudinal axis thereby causing wipe and substantially circumferential contact with the module pin inserted in the end of said contact member within said module locating plate.

10. A zero-insertion force connector according to claim 1, wherein the end of the contact member located in said module locating plate is widened to provide improved access for module pins which may be out of alignment.

* * * * *